United States Patent [19]

Moore

[11] Patent Number: 4,675,691

[45] Date of Patent: Jun. 23, 1987

[54] SPLIT CURVED PLATE ANTENNA

[76] Inventor: Richard L. Moore, P.O. Box 689, Mojave, Calif. 93501

[21] Appl. No.: 737,214

[22] Filed: May 23, 1985

[51] Int. Cl.[4] ..... H01Q 1/36; H01Q 9/06

[52] U.S. Cl. ..... 343/908; 343/761

[58] Field of Search ..... 343/908, 745, 746, 825, 343/826, 828, 831, 792

[56] References Cited

U.S. PATENT DOCUMENTS

| | | | |
|---|---|---|---|
| 1,901,025 | 3/1933 | Franklin | 343/825 |
| 2,171,256 | 8/1939 | Moullin | 343/826 X |
| 2,311,364 | 2/1943 | Buschbeck et al. | 343/792 |
| 2,359,620 | 10/1944 | Carter | 343/792 |
| 2,465,416 | 3/1949 | Aram | 343/767 |
| 2,480,182 | 8/1949 | Clapp | 343/826 X |
| 2,633,532 | 3/1953 | Sichak | 333/242 X |
| 2,812,514 | 11/1957 | Smith | 343/767 X |
| 2,818,565 | 12/1957 | Ajioka et al. | 343/767 |
| 3,914,766 | 10/1975 | Moore | 333/99 PL X |
| 3,967,276 | 6/1976 | Goubau | 343/828 X |

FOREIGN PATENT DOCUMENTS

| | | | |
|---|---|---|---|
| 0680247 | 2/1964 | Canada | 343/908 |
| 1241875 | 6/1967 | Fed. Rep. of Germany | 343/908 |
| 0426830 | 11/1947 | Italy | 343/826 |

*Primary Examiner*—Daniel M. Yasich

*Attorney, Agent, or Firm*—Schwartz, Jeffery, Schwaab, Mack, Blumenthal & Evans

[57] ABSTRACT

An antenna for detecting or transmitting polarized radiation. The antenna is small in size (i.e., less than one quarter the wavelength of radiation at its resonant frequency) and is formed by a split-cylindrical capacitor which comprises of a pair of curved plate conductors which are curved about an axis of rotation centered on a plane which coincides with the direction of propagation of the polarized radiation. The curved plate conductors are disposed on opposite sides of the plane, facing each other and are separated by a gap through which the plane extends.

14 Claims, 8 Drawing Figures

SPLIT CURVED PLATE ANTENNA

FIELD OF THE INVENTION

The present invention relates to an antenna for transmitting and receiving radiation, and more particularly to a highly efficient antenna having a physical length which is short relative to the wavelength of the detected or transmitted radiation.

BACKGROUND OF THE INVENTION

For conventional antennas used either in detecting the electric fields of incoming radiation or in generating an electric field to emit outgoing waves, the design is dominated by the need to provide dimensions of the order of the wavelength of the detected or emitted radiation.

The sole known exception to this rule in general use is the well-known whip antenna. Another exception is my previous invention described and claimed in U.S. Pat. No. 3,914,766, entitled "Pulsating Plasma Device." This antenna is governed by the natural resonant frequency of the plasma. The present invention shows how a short antenna can be constructed using an electrostatic capacitor such as a split-cylindrical capacitor, as the radiating member of a resonant circuit. Since capacitors may be constructed in a wide variety of geometric shapes, requiring only a gap between two conductors which are electrically insulated from each other, a similar variety of antennas may be constructed by using suitable electrical components to provide resonance in the total electric circuit which includes the antenna as one element.

It is known from the extensive literature that the design problem for a particular use of the whip antenna is to obtain the proper value of Q over the frequency range of intended use. For the whip antenna the Q is approximately inversely proportional to the cube of the product of the antenna length and the frequency of use.

Contrast that situation with the present invention where it has been found that the Q of the split cylindrical antenna is proportional to the product of the frequency and the radius of the cylinder divided by the square of the length. Obviously the Q of the antenna will increase with frequency, all else being fixed, and therefore if desired the bandwidth can be much greater than that of a whip antenna designed for the same Q and central frequency.

The geometry of this antenna gives it a major advantage over the whip antenna. Because of its short vertical length it can be more easily and conveniently mounted on a vehicle. Its ability to detect horizontally polarized radiation when its major axis is vertical is another advantage when mounted on a vehicle. Since two major factors affect the polarization of incoming radiation, (the polarization of the transmitter and the reflection from the nearby ground), in many circumstances, the horizontally polarized radiation received at the vehicle would provide a much greater signal than the vertically polarized component detected by the usual whip antenna.

As used herein, a short length antenna is defined as one which has a length equal to or less than one quarter of a wavelength ($\lambda/4$) of its resonant frequency. Usually such short antennas typically exhibited a high Q or a rather sharp tuning peak.

Prior to the present invention, effective high frequency antennas, such as towers or beam antennas, were too large for house or apartment use. Many amateur radio operators resorted to apartment radiators, outdoor clothes lines, long wires stretched between poles or trees, house gutters and downspouts, flagpoles, and even bedsprings as compromise full size antennas.

For relatively small conventional indoor antennas (such as a dipole), small size, a lossy RF environment, and dielectric losses from wood, plaster, and masonry are serious handicaps to effective reception and transmission.

In portable and mobile applications, high frequency antennas usually require a loading coil to tune out capacitive reactance. Such coils introduce a coil loss which increases as the required resonating inductance gets larger and the radiation resistance decreases, i.e., at lower frequencies.

Sichak, in U.S. Pat. No. 2,633,532, describes a helically-slotted cylindrical antenna for transmitting high frequency energy. The pitch of the antenna slot is equal to an integral number of wavelengths of the frequency being radiated. Thus, Sichak is an example of a relatively long antenna.

Smith, in U.S. Pat. No. 2,812,514, describes a helically-slotted antenna having both right and left hand slots for radiating circularly polarized electromagnetic waves which have both vertical and horizontal components.

Carter, in U.S. Pat. No. 2,359,620, describes a short wave antenna for use over a wide band of frequency ranges. The antenna comprises a pair of parallel conducting discs facing each other and having axially aligned centers. The discs are energized at the center of their opposing faces and are designed so that their size is a fraction of the desired wavelength.

German Auslegeschrift No. 1,241,875 describes a high frequency antenna comprising a hollow metallic cylinder divided by two continuous, opposing parallel slits which divide the cylinder into two half cylinders. The half-cylinders are insulated from each other. The diameter of the cylinder is approximately $\lambda/3$ and the width of a slit is approximately $\lambda/10$. The length of the cylinder is about 10 $\lambda$. Thus, the antenna of German No. 1,241,875 is well over an order of magnitude larger than a short antenna as defined herein. The direction of transmission is along the axis of the cylinder.

While various antenna configurations utilizing some generally cylindrical conductors are described, for example, in U.S. Pat. Nos. 2,238,770, 2,633,532, 2,747,182, and 2,812,514, no antenna is known wherein the length of the antenna is less than $\lambda/4$ and wherein the Q of the antenna can be readily engineered by varying the radius of an axis of revolution of a pair of capacitor plates and a gap space between the plates.

In addition, while various slotted antenna and plate antenna configurations are described (for example in U.S. Pat. Nos. 2,359,620, 2,436,408, and 2,625,654), the prior art fails to provide a compact versatile antenna suitable for use in such wide ranging applications as FM receivers, high frequency HAM radio, and mobile radios.

Thus, a need exists for a small and efficient broad band antenna that can be used with both portable and mobile operations for receiving and transmitting polarized radiation.

SUMMARY OF THE INVENTION

Accordingly, it is an object of the present invention to provide an antenna having a broad bandwidth.

It is a further object of the invention to provide an antenna having a "Q" which is directly proportional to the frequency received or transmitted and inversely proportional to the square of the length.

It is a still further object of the invention to provide an antenna for detecting polarized radiation, the antenna being relatively small in size and able to rotate to match the antenna directivity to the direction of propagation of the radiation.

It is the still further object of the invention to provide an electrically tunable FM antenna for stationary or mobile use.

It is the further object of the invention to provide a mechanically tunable high frequency antenna for amateur radio transmission and reception.

These, as well as other objects and advantages are realized by providing an antenna for transmitting or receiving polarized radiation having a wavelength λ, the antenna comprising a first conductor concavely curved with respect to a plane which defines the direction of propagation of the radiation, and a second conductor disposed on an opposite side of and also concavely curved with respect to that plane. The first and second conductors are separated by a gap which is coincident with the plane to thereby define a capacitance. An inductor for resonating the antenna at a desired frequency is provided, with the entire antenna having an effective length of less than λ/4.

BRIEF DESCRIPTION OF THE DRAWINGS

The accompanying drawings, which are incorporated in and form a part of the specification, illustrate various embodiments of the present invention and together with the description serve to explain the principles of the invention. In the drawings, like or similar members are given the same reference numeral.

In the drawings.

DETAILED DESCRIPTION OF THE PREFERRED EMBODIMENTS

Figure 1:
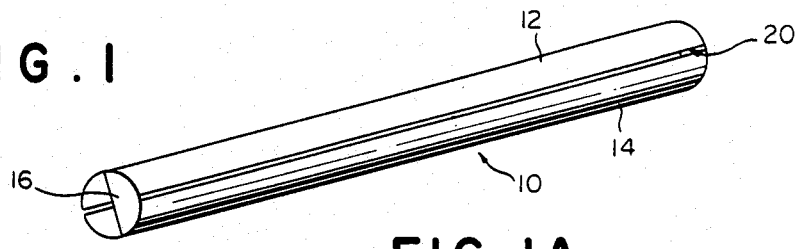
FIG. 1 is a perspective view of an antenna according to the present invention illustrating a plate inductance between semi-cylindrical conductors.
Figure 1A:
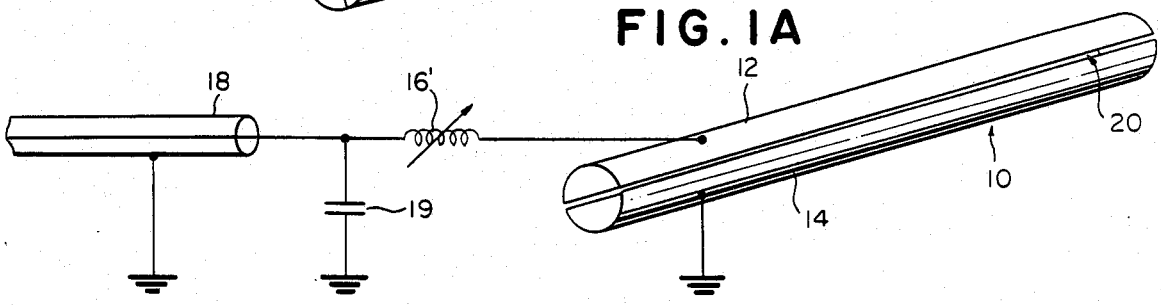
FIG. 1A is a perspective view of a second embodiment of an antenna according to the present invention wherein an inductance is spaced apart from the semi-cylindrical conductors.
Figure 2:
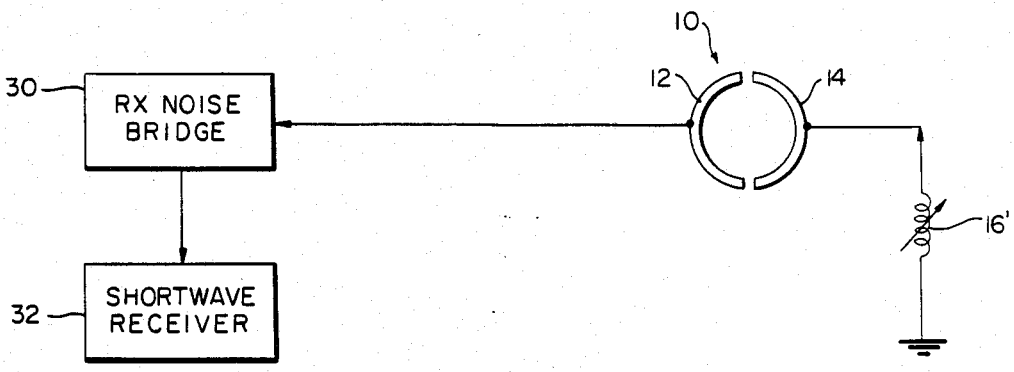
FIG. 2 is a schematic diagram of a circuit used to determine empirically the behavior of an antenna according to the embodiment of FIG. 1A.

Reference will now be made to the various drawings to describe the presently preferred embodiments of the invention. FIG. 1 depicts a resonator antenna according to one embodiment of the present invention. It shows an antenna 10, in the form of a cylinder which is formed from semi-cylindrical halves 12 and 14 concavely curved with respect to a plane therebetween. The conductors 12 and 14 are separated by a gap coincident with the plane and thereby form a capacitor. The antenna is resonated at the desired operating frequency by a suitable inductor 16. Inductor 16 may comprise a plate inductor positioned between the plates 12 and 14 as illustrated in FIG. 1 or as illustrated in FIGS. 1A and 2, an inductor 16' may be positioned external to the cylinder but physically close to minimize transmission line effects. Inductor 16 is formed from a flat copper plate screen in a fashion which will be readily apparent to one of ordinary skill in the art.

Preferably, the inductor 16 is variable, so that the antenna may be tuned in the manner described below.

The system also preferably includes an impedance matching circuit 19 for coupling to transmission line 18. The radiation impedance of the antenna is small compared to those used conventionally. Therefore, most if not all conventional impedance matching circuits would not serve suitable circuits for use with inductor 16. In the preferred embodiment, a circuit such as that illustrated, based on one illustrated in the Radio Amateur's Manual, served well. This circuit comprises a coupling impedance to make the circuit comprising the antenna, inductor, and impedance match the impedance of the transmission line.

The radiation being transmitted or received is preferably applied to or taken from the antenna at the center or either end of the capacitor plates 12 and 14 as illustrated in FIG. 1A. The radiation emitted or received is polarized in the plane perpendicular to the plane of the gap 20 which is formed between the opposing conductors 12 and 14 and coincident with the central longitudinal axis of the cylinder which they define.

As will be apparent to one of ordinary skill, the antenna may be used in conjunction with a conventional FM tuner, such as the type employing a quartz synthesizer circuit.

In conventional dipoles or loop antennas, radiation resistance decreases as length decreases. See *AARL Antenna Book*, 1983, Chapter 2. With the present invention a scaling relationship between the radiation resistance (R in Ω) and length L has been empirically determined to be approximated by the following formula:

$$R=(C_1)\,(L/2)\,(G/(ka)^2)$$

where $C_1$ = a constant k = the wave number of the radiation (proportional to frequency)

a = the radius of cylinder in inches

L/2 = the half length of the antenna

G = the gap between capacitor plates.

In determining the above scaling relationship, various antennas 10 were constructed on cylindrical forms which comprised lengths of PVC tubing of various diameters. Two semi-cylindrical conductors 12 and 14, which functioned as the antenna plates, defining two sides of the antenna, were made of aluminum foil and were resonated at the desired operating frequency by a suitable variable coupling inductor 16. As shown in FIG. 2, one side of the antenna was coupled to an R-X Noise Bridge 30. The other side of the antenna was coupled to the variable coupling inductance. The output of noise bridge 30 was connected to a conventional shortwave receiver 32 such as Heathkit Shortwave Receiver, Model GR54, tunable from 400 kHz to 30 MHz. the capacitance of the antenna was measured by an RLC meter such as Heathkit RLC meter. Various antennas were tested, with the radius, a, ranging from $\frac{1}{2}$ to 2 inches, the half lengths, L/2, being either 6 or 19 inches, and the gap between plates G being either $\frac{1}{4}$ or $\frac{3}{4}$ inches at the edges. As indicated by the above scaling formula, in all cases, the radiation resistance R of the antenna decreased proportional to the square of the frequency, in direct contrast to whip-type antennas wherein the radiation resistance increases proportionally to the square of the product of the frequency and length of the antenna, all other properties being equal.

Figure 2A:
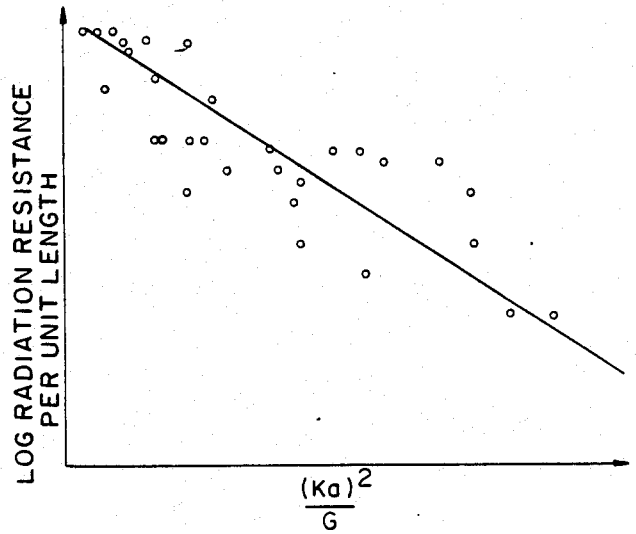
FIG. 2A is a plot obtained using the circuit of FIG. 2 of the log of radiation resistance per unit length versus the square of the wavenumber times radius, all divided by the gap width according to the present invention.

In FIG. 2A, a plot appears of the log of the radiation resistance per unit length as a function of $(k \cdot a)^2/G$, illustrating the scaling relationship above.

For each of the antennas tested, the Q or bandwidth was calculated as a function of frequency from the capacitance and the radiation resistance. The present antenna was found to be applicable to both broadband (low Q) applications and also to applications where selectivity (high Q) is important. Thus, by engineering the relationship between the radiation resistance and the capacitance of the antenna, it can be designed for either narrow or broad bandwidth applications. In practice, this means simply that one increases the gap width G in order to increase the bandwidth of the system.

The curved plate antenna 10 described above, being formed from rotational surfaces, has an electric field E as illustrated in FIG. 1A, represented by field lines extending between the curved plates in a manner similar to a conventional capacitor. This is in contrast to a whip antenna or the like where the capacitance is formed between the conductor and ground and resonated by a coil, usually at the base of the whip.

With the present invention, the maximum radiation occurs along the direction of the central plane of the gap, or orthogonally with respect to the electric field created by semi-cylindrical plates 12 and 14.

Utilizing the split-cylindrical antenna, an effective and efficient radiator or receiver of radiation having a length considerably less than $\lambda/4$ can be made.

Figure 3:
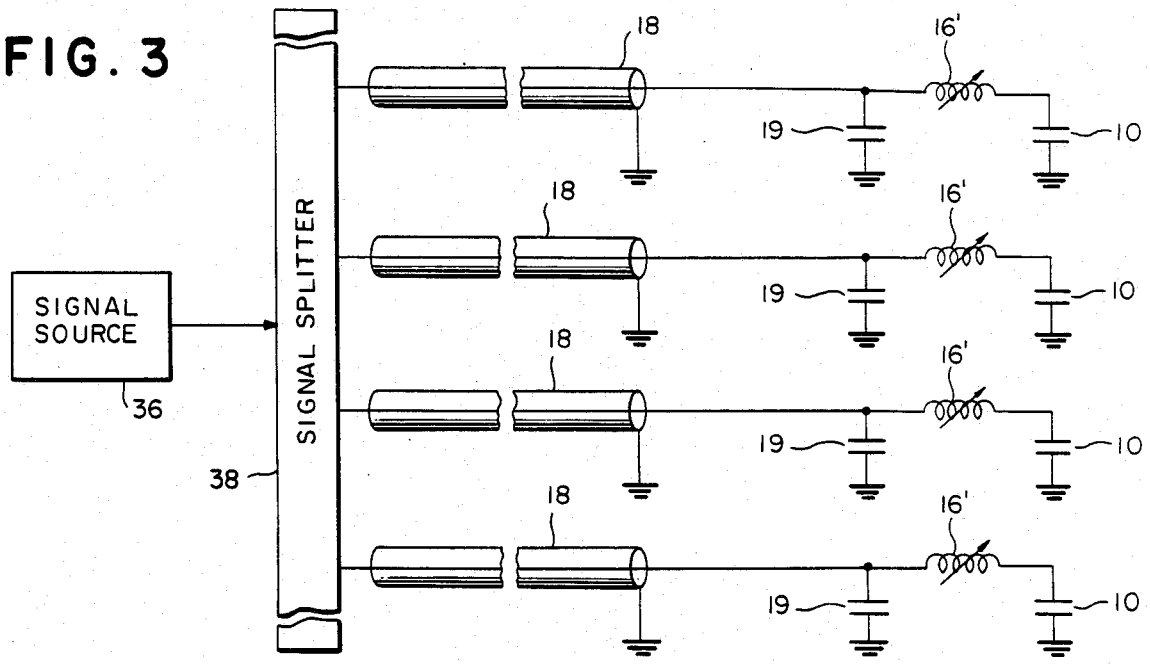
FIG. 3 is a partially schematic perspective view of a multi-antenna array tunable by a single variable inductance.

Antennas according to the present invention should also prove to be exceptionally useful as elements of phased arrays. Such arrays are conventionally used to transmit or receive highly directional radiation. An array using antennas according to the present invention to transmit is shown in FIG. 3. A signal from signal source 36 is split in signal splitter 38 into signals for each element of the array, which each include an inductor 16, antenna 10, and coupling impedance 19. The individual signal for each array element is respectively carried by a transmission line 18. These transmission lines serve as delay lines. Thus, the length of each line 18 is determined by the pattern desired from the array. To transmit waves which are perpendicular to the line of the array, the delay lines would all be the same. If waves are to be transmitted along the line of the array then the temporal separation of the elements must be coordinated with the length of the delay line so that the delay lines will result in the constructive addition of waves incident on the array from the preferred direction. In addition each individual element must have its slot pointing in the direction of propagation. It will be understood by one of ordinary skill in the art that any other known means for controlling phase in signal transmission may be used instead of varying the lengths of transmission lines 18.

Figure 4:
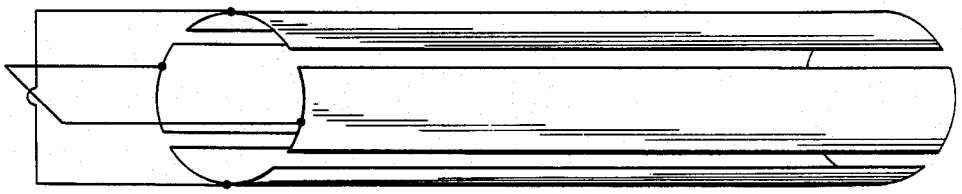
FIG. 4 illustrates a perspective view of an alternative embodiment of the invention wherein an antenna is formed from four quarter cylinder sections.

Rotational surfaces other than semi-cylindrical can also be utilized in practicing the present invention. For example, as illustrated in FIG. 4, each semi-cylindrical curved plate can be axially divided to form a rotational surface comprising opposing quarter-cylindrical surfaces.

Figure 5:
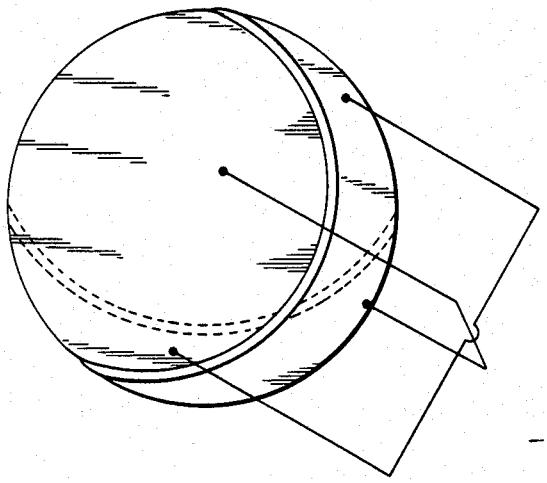
FIG. 5 illustrates a perspective view of an embodiment of the invention wherein an antenna is formed from sections of a spheroid.
Figure 6:
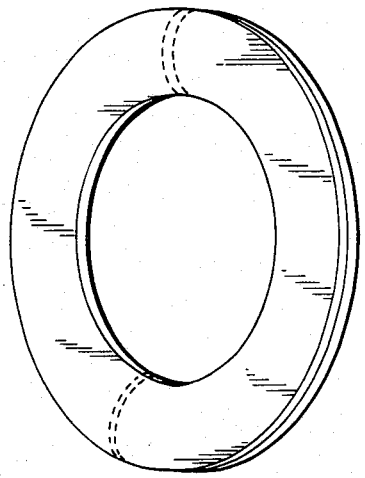
FIG. 6 illustrates a perspective view of another alternative embodiment wherein an antenna is formed from opposing sections of a toroid.

Still other antenna geometries may be used in accordance with the present invention, for example, a spherical form, such as that depicted in FIG. 5, or a toroidal form, such as that depicted in FIG. 6, can be utilized. In the example of FIG. 5, the curved antenna plates are in the form of hemispheres or quarterspheres depending upon whether a two plate or a four plate antenna is desired.

These variations in configuration provide the designer a wide range of flexibility in choosing an antenna to generate any of an equally wide range of intensity profiles. Dividing the solid geometrical figures into more than two symmetrical segments, for example, results in a corresponding increase in the number of lobes of maximum intensity in the generated intensity profile. Thus the quarter-cylindrical antenna generates four lobes instead of the two lobes generated by the semicylindrical antenna. Similarly, the alternative symmetries of the alternative rotational surfaces permit generation of intensity profiles having alternative symmetries. For example, both the spherical and toroidal forms provide a uniform radiation distribution in the plane perpendicular to their central axis.

The geometry of the structure to which the antenna is to be mounted may also play a role in antenna geometry selection. A cylindrical structure, such as the fuselage of an aircraft, might indicate the use of a toroidal antenna. A spherical structure, such as a satellite, might suggest the use of a spherical antenna, as might an application where the antenna is to be mounted on the end of a long rod or strut.

In the case of FIG. 6, the curved antenna plates are in the form of a toroid or donut, split along a plane passing through its circumference.

The foregoing description of a preferred embodiment of the invention has been presented for purposes of illustration and description. It is not intended to be exhaustive or to limit the invention to the precise forms disclosed, and obviously many modifications and variations are possible in light of the above teachings. For example, the antenna may be formed from more than one or two pairs of plates and may comprise for example three or four pairs of opposing plates which combine to define a cylinder, sphere, or toroid. The embodiments were chosen to describe in order to best explain the principles of the invention and its practical application to thereby enable others skilled in the art to best utilize the invention in various embodiments and with various modifications as are suited to the particular use contemplated. It is intended that the scope of the invention be defined by the claims intended hereto.

What is claimed is:

1. An antenna for transmitting or receiving radiation having a wavelength $\lambda$ comprising:

a first conductor having a side thereof concavely curved with respect to a plane;

a second conductor, disposed directly on an opposite side of said plane and having a side concavely curved with respect to said plane such that the concave sides of said first and second conductors face each other, said second conductor having a length substantially equal to the length of said first conductor, said first and second conductors being separated by a gap coincident with said plane to thereby define a capacitance;

an inductor coupled to at least one of said first and second conductors and connected to form an LC resonance circuit with said first and second conductors; and wherein said first and second conductors have a length of approximately $\lambda/4$ or less at a resonant frequency of said LC resonant circuit.

2. The antenna according to claim 1 wherein said inductor is a plate inductor disposed between and connected to said first and second conductors.

3. The antenna according to claim 2 wherein said first and second conductors are each in the form of a semi-cylinder facing each other from opposite sides of said plane.

4. The antenna according to claim 2 wherein said first and second conductors are each in the form of a hemisphere facing each other from opposite sides of said plane.

5. The antenna according to claim 2 wherein said first and second conductors are each in the form of a semi-torus facing each other from opposite sides of said plane.

6. The antenna according to claim 2 wherein each of said first and second conductors is in the form of a plate concavely curved about an axis of rotation centered on said plane.

7. The antenna according to claim 1 wherein said first and second conductors are each in the form of a semi-torus facing each other from opposite sides of said plane.

8. The antenna according to claim 1 wherein said first and second conductors are each in the form of a hemisphere facing each other from opposite sides of said plane.

9. The antenna according to claim 1 wherein each of said first and second conductors is in the form of a plate concavely curved about an axis of rotation centered on said plane.

10. The antenna according to claim 9 further comprising a second antenna connected with the first mentioned antenna and means for controlling phase connected between said antennas.

11. The antenna according to claim 1 further comprising a second antenna connected with the first mentioned antenna and means for controlling phase connected between said antennas.

12. The antenna according to claim 11 wherein said antenna has first and second longitudinal ends and said polarized radiation is fed to and taken off of one of said ends.

13. The antenna according to claim 1 wherein said first and second conductors are each in the form of a semi-cylinder facing each other from opposite sides of said plane.

14. The antenna according to claim 3 wherein the antenna has a radiation resistance R and a length L which are related according to the formula:

$$R=(C_1)(L/2)(G/(ka)^2)$$

Where $C_1$ = a constant k = the wave number of the transmitted or received radiation a = the radius of the semi-cylinder G = the distance between conductors.

* * * * *